United States Patent [19]

Schweer et al.

[11] Patent Number: 4,482,844

[45] Date of Patent: Nov. 13, 1984

[54] LAMP DIMMER

[75] Inventors: Carl Schweer, Petersborough; R. Carl Rath, Putnam, both of Canada

[73] Assignee: Wide-Lite International Corporation, San Marcos, Tex.

[21] Appl. No.: 464,405

[22] Filed: Feb. 7, 1983

[30] Foreign Application Priority Data

Feb. 17, 1982 [CA] Canada ..... 396452

[51] Int. Cl.[3] ..... G05F 1/00

[52] U.S. Cl. ..... 315/194; 315/287; 315/291; 315/311; 315/297

[58] Field of Search ..... 315/311, 291, 287, 194, 315/297

[56] References Cited

U.S. PATENT DOCUMENTS

| | | | |
|---|---|---|---|
| 3,265,907 | 8/1966 | Kurata et al. | 307/83.5 |
| 3,265,930 | 8/1966 | Powell | 315/209 |
| 4,087,702 | 5/1978 | Kirby | 315/194 |
| 4,114,071 | 9/1978 | Thrower et al. | 315/291 |
| 4,189,664 | 2/1980 | Hirschfeld | 315/297 |
| 4,350,935 | 9/1982 | Spira et al. | 315/291 |
| 4,371,812 | 2/1983 | Widmayer | 315/291 |
| 4,395,660 | 7/1983 | Waszkiewicz | 315/291 |

*Primary Examiner*—Harold Dixon

*Attorney, Agent, or Firm*—Vaden, Eickenroht, Thompson, Bednar & Jamison

[57] ABSTRACT

A lamp dimmer suited for fluorescent and other lamps which controllably notches the applied voltage to a lamp circuit each half cycle. Progressively larger dimming control voltages produces progressively wider notches as well as progressively causing the notches to be further from the zero-crossing occurrence toward the peak occurrence of the half cycles, thereby providing means for varying power to the light circuit. Optocoupler means is employed with respect to a power output bridge to isolate the control circuit from the power output circuit to the lamp. A photosensor used to sense the ambient light conditions is used to produce the dimming control voltage so as to achieve a balancing effect between the ambient and the artificial light produced by the lamp.

11 Claims, 6 Drawing Figures

LAMP DIMMER

BACKGROUND OF THE INVENTION

1. Field of the Invention

This invention pertains to light dimming systems and more particularly to a system suitable for dimming one or more flourescent lamps, although also being suitable for dimming incandescent and high intensity, gaseous discharge lamps.

2. Description of the Prior Art

Light intensity of a lamp is dependent, after it reaches normal operation, on the power delivered to the lamp. That is, the greater the power, the brighter the lamp. It is possible to put a variable resistor in series with such a lamp for limiting the power to the lamp, and hence, varying the lamp intensity. However, such a device has several shortcomings. The primary shortcoming is that a resistor used in this fashion dissipates heat and, therefore, provides dimming at a loss in efficiency. Second, a variable resistor alone does not provide means for automatically adjusting light level to compensate for the brightness of an illuminated area from sunlight or other source external to the system being controlled.

Another procedure that has been employed in limiting power to the lamps circuit is to provide current to the ballast-and-lamp network only during a portion of each cycle of line current. This can be done by switching the current off each time there is a zero-crossing of line current and then switching the current on at a predetermined time after the zero-crossing time. The portion of on time determines the amount of average power applied each cycle and, hence, the brightness of the lamp or lamps. The problem with this approach is that too large a portion of non-applied current each cycle in the vicinity of the zero-crossing event prevents the lamp network from lighting the lamps at all.

It has also been observed that notching in the vicinity of a sine wave peak, especially when small notches are taken to produce small amounts of dimming, causes undesirable rapid jumps in power. The jumps are undesirable because they can cause damages surges to the lamp structure.

Therefore, it is a feature of the present invention to provide an improved system for dimming fluorescent or other lamps that provides improved and acceptable variable notching of the voltage applied to the lamp network for reducing the overall power applied thereto.

It is another feature of the present invention to provide an improved system for dimming fluorescent or other lamps by controlling the amount and location of a variable notch within a voltage cycle for the voltage applied to the lamp network, thereby limiting the overall power applied thereto without risking turning off the lamps or harmfully surging the lamps.

It is yet another feature of the present invention to provide an improved system for dimming fluorescent or other lamps by automatically controlling the amount of power applied to the lamp network from each cycle of line voltage as controlled by a photosensitive input means that senses the amount of ambient light.

It is still another feature of the present invention to provide an improved system for dimming fluorescent or other lamps only after stabilized operation has been attained.

It is yet another feature of the present invention to provide an improved system for automatically dimming fluorescent or other lamps controlled by an input that is the result of a comparison between a photosensed input and a standard input.

SUMMARY OF THE INVENTION

The invention embodiment disclosed shows the lamp (or lamps) being subject to dimming by being connected to the ac line via a diode bridge routing network. This network routes first the positive and then the negative half cycles of line voltage through a transistor switch. This switch is controlled on and off by a photo receiver-driver combination, as controlled by a pulse timer. The effect of operation is a notch of voltage interruption during each half cycle. A delay timer connected to the pulse timer determines where the notch from the pulse timing operation occurs. Also, within a range, as the delay time increases, the notch becomes larger as determined by the charge rate of an RC network which controls a pulse timer circuit.

The principal input to the delay timer network is a control voltage from a photosensor, which compares a sensed-derived voltage with an adjustable standard. When the control voltage output exceeds a lower limit, the delay timer is activated at a time for each sensed zero-voltage crossing of line voltage determined by the amplitude of that control voltage.

A manual override or alternate control and a fixed-delay-after-initial-turnon network, which is conveniently set for approximately a nominal two minutes, are connected through a steering switch with the output of the photosensor network for providing alternate outputs to the lower limit network.

BRIEF DESCRIPTION OF THE DRAWINGS

So that the manner in which the above-recited features, advantages and objects of an invention, as well as others which will become apparent, are attained and can be understood in detail, more particular description of the invention briefly summarized above may be had by reference to the embodiment thereof which is illustrated in the appended drawings, which drawings form a part of the specification. It is to be noted, however, that the appended drawings illustrate only a preferred embodiment of the invention and are therefore not to be considered limiting of its scope, for the invention may admit to other equally effective embodiments.

IN THE DRAWINGS

Figure 1:
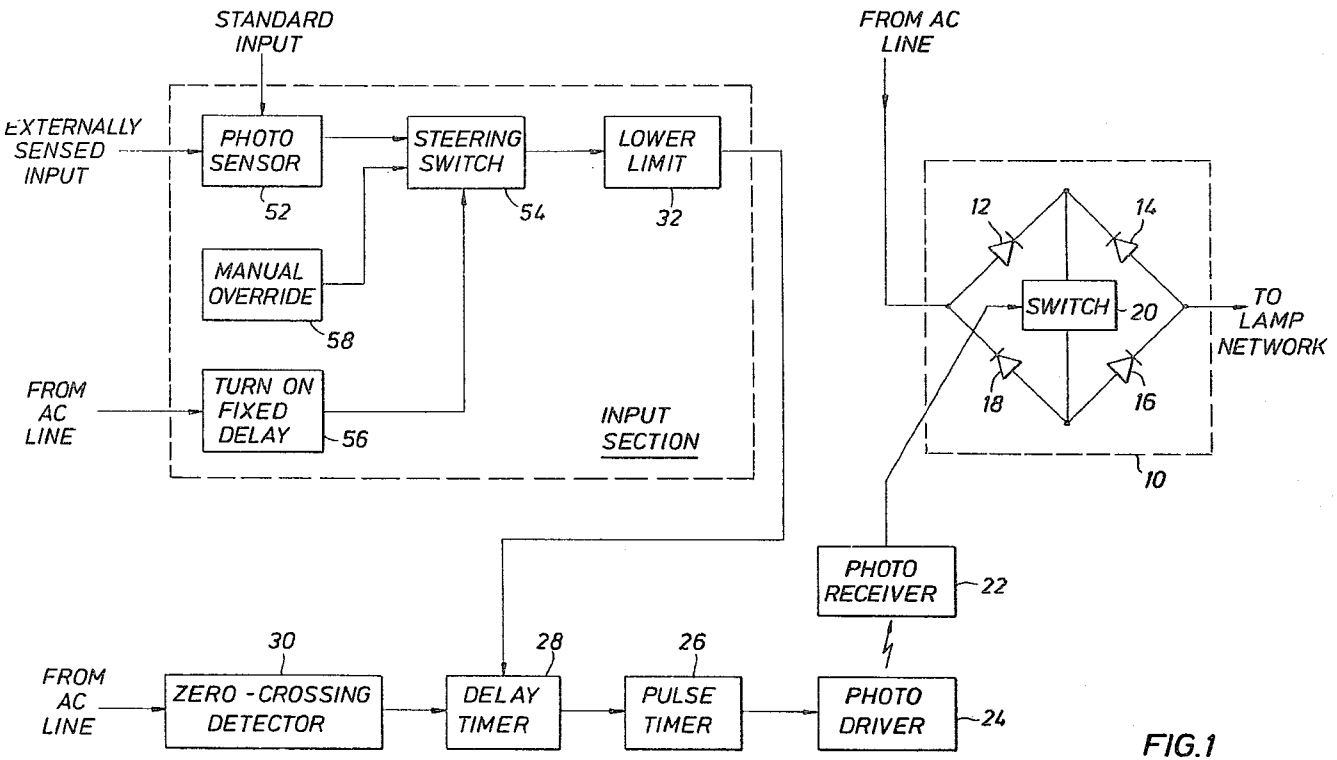

FIG. 1 is a block diagram of a preferred embodiment of the present invention.

Figure 2:
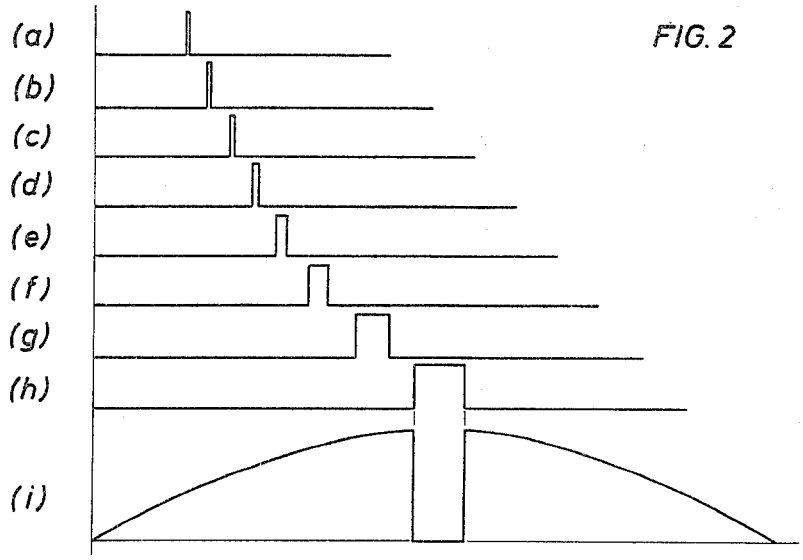

FIG. 2 is a series of waveforms showing the alternate waveforms for operations at various delay times for the embodiment of the invention shown in FIG. 1.

Figure 3:
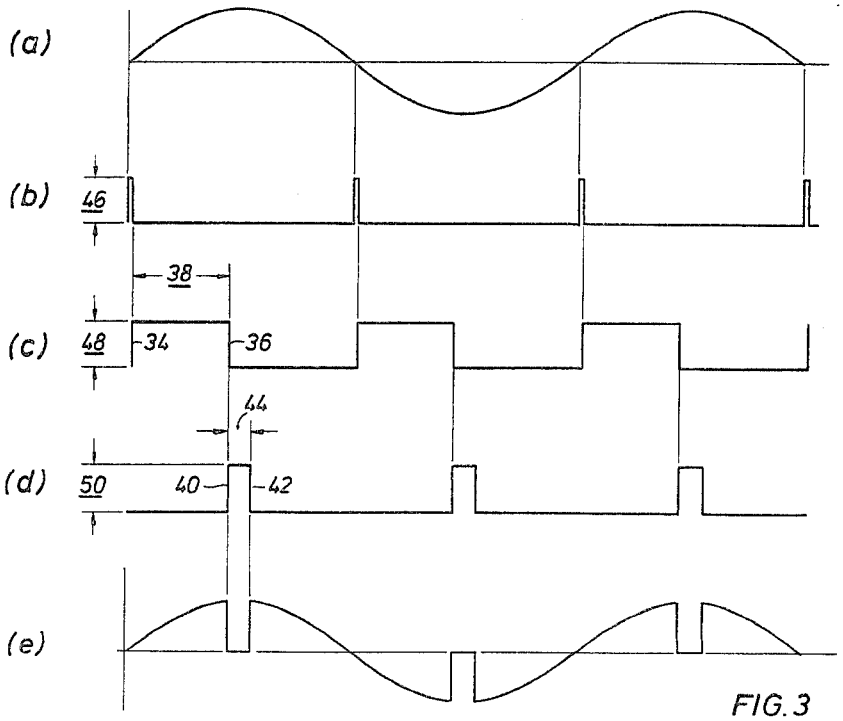

FIG. 3 is a series of timing waveforms showing several key waveforms during a typical operation for the embodiment of the invention shown in FIG. 1.

Figure 4A:
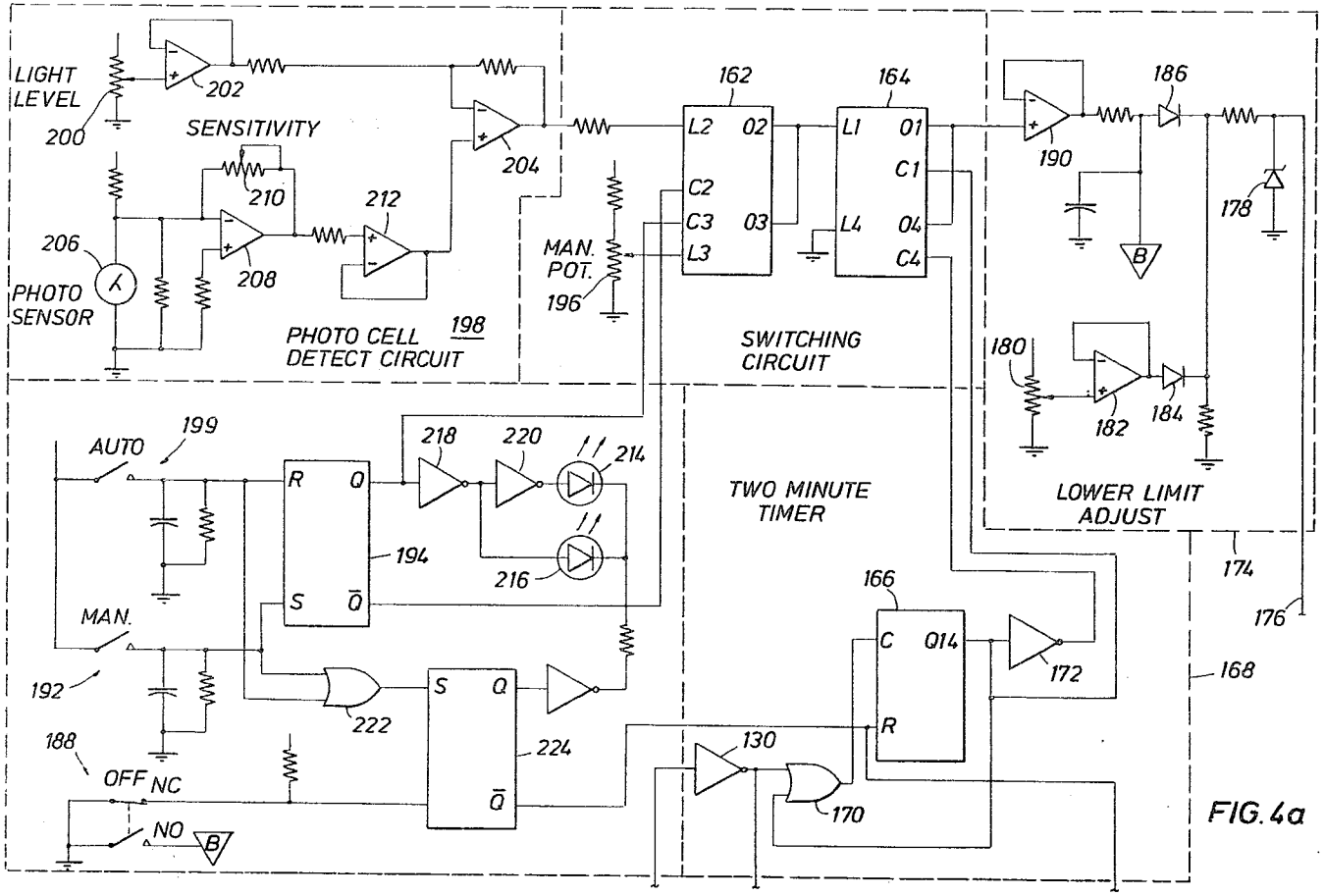
Figure 4B:
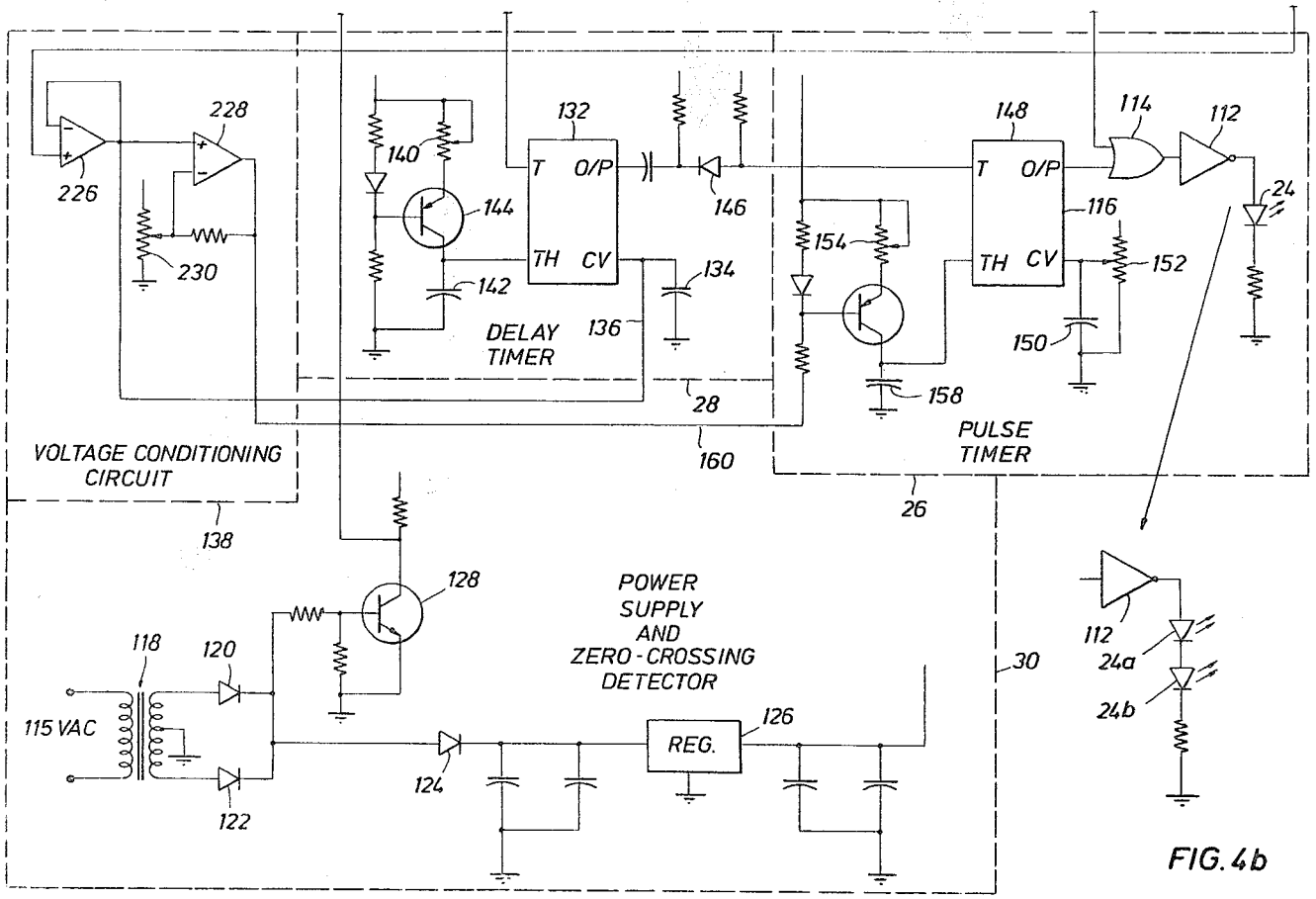
Figure 4C:
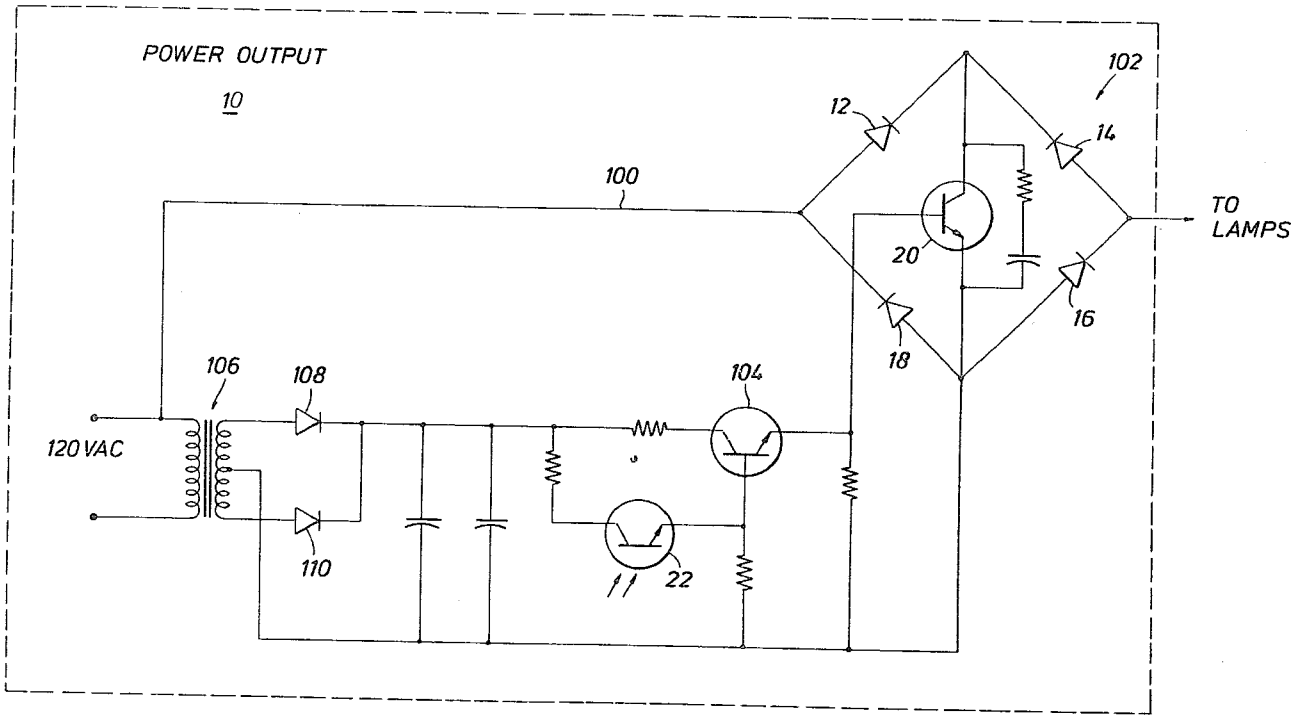

FIGS. 4*a*–4*c* is a simplified schematic diagram of a preferred embodiment of the present invention.

DESCRIPTION OF THE PREFERRED EMBODIMENT

Now referring to the drawings, and first to FIG. 1, a block diagram of a preferred embodiment of the invention is shown. The apparatus is connectable typically to a network comprising ballast components and one or more flourescent lamps (not shown) through diode bridge routing means 10 comprising diodes 12, 14, 16 and 18, although other types of lamps can also be connected to the circuit shown. Such network is referred to herein sometimes as the lamp network and sometimes as the ballast and lamp network. Diodes 12 and 14 are connected together at their cathodes and diodes 16 and 18 are connected together at their anodes. The anode of diode 12 is connected to the cathode of diode 18 and the anode of diode 14 is connected to the cathode of diode 16. This latter connection is the one to the lamp network, and the former connection is the connection to the ac line. An electronic switch in the form of an npn triode 20 is connected between the junction connection of diodes 12 and 14 and the point of the connection between diodes 16 and 18.

It may be seen that positive half cycles of line voltage is routed through diode routing means 10 via diode 12, transistor switch 20 and diode 16, whereas negative half cycles are routed through means 10 via diode 18, switch 20 and diode 14. When the switch is closed, the full brightness power is applied to the lamp network. When the voltage of each half cycle is interrupted, however, then less than full brightness power is applied to the lamp network. The duration of such interruption and the location of the interruption determines how much the lamps are dimmed with respect to full brightness. The location of the interruption, or notch, is important, since when the interruption (notch) is taken at that position of the cycle where the voltage and current amplitudes are near their peak values, more power is removed from application to the lamps than when the notch is taken at somewhere near a nominal voltage amplitude within the cycle, such as near the zero-crossing occurrence. Therefore, both location and duration of the interruption are important to the dimming operation.

It has been discovered that a notch near the start of each half cycle which is narrow does not cause possible interruption of lamp operation and does afford a small amount of dimming without shocking the lamp network with two closely spaced voltage transition points at appreciable amplitude. It has also been discovered that a broader notch which occurs in the vicinity of the peak amplitude is useful in providing greater dimming without risking turn-off of the lamps in the lamp network since the notch is not contiguous with the zero-crossing locations. Moreover, such operation does not adversely shock the lamps since the transition edges of the notch are not closely spaced. Therefore, as more fully explained hereinafter, as more dimming is desired, the notch is first shifted from a location near the zero-crossing event in a direction toward the peak and then the notch is widened until, when the greatest amount of dimming is provided, the notch is at the approximate peak location of the voltage half cycles and the notch is at its widest dimension.

Now returning to FIG. 1 and the operation of routing means 10 connected to the lamp network, switch 20 is conveniently a base-driven transistor, as is explained more fully hereinafter. The drive to the base of the transistor is provided by a photoreceiver portion 22 of an optocoupler, which, in turn, is activated by photo-driver 24. The output of the photo-driver is an optical or light pulse, the location and duration of which is determined by the pulse output from pulse timer 26.

The input to pulse timer 26 is from delay timer 28, which has two inputs. The first is a pulse from zero-crossing detector 30, which determines the leading and rising edge of the output from the delay timer. The second input to the delay timer is from lower limit network 32 of the input section. The voltage amplitude from this network determines the trailing and descending edge of the square wave output from the delay timer. The position of this trailing edge determines the location and duration of the output from pulse timer 26, as can be more fully appreciated with reference to FIGS. 2 and 3.

FIG. 2(*i*) shows the positive half-cycle of the voltage output to the lamp network with a notch or interruption therein at a location near the peak voltage amplitude. The location and duration or width of the notch is determined by the pulse output from pulse timer 26, as shown in FIG. 2(*h*). As can be further seen, the notch can be located earlier within the half-cycle, as shown at FIGS. 2(*a*)–2(*g*) to provide less ultimate dimming. It may be further noted that as the location is moved earlier and earlier, the notch is narrower and narrower, at least to a point (FIG. 2(*c*)). However, for the earliest three locations shown at FIGS. 2(*a*)–2(*c*), the width of the pulse is the same.

It should be remembered that this still produces different dimming at these three locations because the amplitude of the voltage in FIG. 2 is different at these locations and, hence, notching for the same duration but at these different locations, produces a different amount of dimming.

FIG. 3 shows a series of related waveforms operating in the manner described above to accomplish the functional operation of notching the ac voltage applied to the lamp network. FIG. 3(*a*) shows the regular sine wave voltage of the ac distribution line, normally occurring at a freqeuncy of 60 Hz. There are two zero-voltage crossings per cycle, at the point where the voltage goes from its positive half cycle, to its negative half cycle and again at the point where the voltage goes from its negative half cycle to its positive half cycle. It is assumed that the respective voltage half cycles are the same except for polarity.

Zero-crossing detector 30 produces a very short pulse at the occurrence of each zero-crossing of the line voltage. These pulses are shown in FIG. 3(*b*). It may be seen that the trailing edges of these short pulses determine leading edges 34 of the output from the delay timer, as shown in FIG. 3(*c*). Depending on the voltage from the lower limit network to delay timer 28, trailing edge 36 occurs at a variable distance 38 from the leading edge. The trailing edge is the control part of the waveform for activating pulse timer 26. It may be seen that edge 36 coincides with leading edge 40 of the output pulse from the pulse timer, as shown in FIG. 3(*d*). Depending on the delay position of the pulse timer within the half cycle, trailing edge 42 from the pulse timer is separated from the leading edge by duration 44. The location and duration of the notch between edges 40 and 42 determines the interruption time in the voltage applied to the lamps, as shown in FIG. 3(*e*).

It may be seen that the functional operation of the various waveforms is dependent on the occurrence of the various leading and trailing edges of the waveforms just described and not on the amplitudes thereof. It may be assumed, for instance, that pulse heights 46, 48 and 50 of the waveforms shown respectively in FIGS. 3(*b*), 3(*c*) and 3(*d*) are the same, although operation can be conducted at different amplitude levels without having a detrimental effect on operation. It is the location and duration of the pulses vis-a-vis the amplitude peaks of the voltage waveform shown in FIG. 3(*e*) that determines the amount of dimming.

Now returning to FIG. 1 and the input section thereof, the ambient light that determines the amount of dimming is applied to photosensor 52. Although operation could be with respect to an absolute level, in the preferred embodiment, an adjustable standard input is also applied to photosensor 52. The difference in these two inputs, provided the externally sensed input is larger, determines the variable output from the photosensor. It will be understood that normal operations will dictate that very bright ambient light will determine the greatest amount of dimming to the fluorescent lamp network. That is, the brighter the ambient light, the less need there is for bright artificial light.

The output from the photosensor is applied through steering switch network 54, which has two other inputs that, when present, override the input from the photosensor. The first of these is from turn-on, fixed delay network 56. When line voltage is first switched on to the lamps, it is assumed that the lamps are cold and will need full voltage to come on and stay on. Therefore, for a fixed period of time, nominally about two minutes, there is an output from network 56 to switch 54 that prevents the application of a dimming control voltage from the photosensor, or from manual override network 58, from being connected to lower limit network 32.

The manual override or alternate network includes a switch for switching out the photosensor network and a variable adjust control for supplying a variable voltage to and through steering switch 54 as the control voltage to lower limit network 32. This control permits an adjustment to any dimming level within the capability of the system independently of the level of ambient lighting.

The lower limit network supplies an output to delay timer network 28 when there is an input thereto in excess of a predetermined lower limit threshold. Also, there is an integration network that prevents dimming fluctuations from occurring in the presence of a spurious spike input to network 32 in the form of temporary darkness or a temporary bright light being sensed by the photosensor, as may occur when a flash picture is taken or a car headlight beam from the outside momentarily sweeps across the sensor.

Now referring to FIGS. 4*a*–4*c*, power from the ac distribution line is applied via line 100 through bridge 102 comprising routing diodes 12, 14, 16 and 18. The applied line current passes through transistor switch 20, as discussed above, the output from bridge 102 being applied to the lamps. Control of switch 20 is by way of base drive, which is applied through power transistor 104, in turn, turned off by photoreceiver 22. The power to photoreceiver 22 and transistor 104 is from transistor 106 and rectifier diodes 108 and 110.

Photodriver 24 is the output element of the pulse timer network and illuminates pulse receiver 22. Note that two separate lamp networks can be operated by two series-connected photodrivers 24*a* and 24*b*, as shown in the lower right corner of FIG. 4*b*, if desired. Operation of a photocontrolled optocoupler isolates the control logic network operating nominally in the low voltage range under about 7 volts, from the power connections at a nominal 120 volts. The input to driver 24 is the output of amplifier 112, which produces an output when there is an input from OR gate 114. One input to gate 114 is an "off control" input. The other is the output from timer network 116.

The basic timing element used in both pulse timer network 26 and delay timer network 28 is a Model 555 timer produced by many manufacturers. In operation, a trigger input is applied when the voltage applied to the input terminal drops below a predetermined level. Normally, this level is one-third of the $V_{cc}$ value applied to the network. When this occurs an internal comparator, sampling the trigger input and an internal voltage level of one-third $V_{cc}$ via an internal voltage divider, causes an internal flip-flop to change state so that a high level voltage is applied to the output terminal. Hence, the output of the timer produces a positive-going leading edge of a rectangular wave with the occurrence of a trigger input.

When there is no control voltage applied, then the internal voltage divider previously mentioned establishes one input to a second internal comparator at two-thirds the applied $V_{cc}$ voltage. The threshold input is the other voltage applied to the second comparator. Therefore, when the threshold voltage exceeds two-thirds of the $V_{cc}$ voltage, there is an output from the second comparator for switching the internal flip-flop back to its initial state. This produces a negative-going output or trailing edge of the output rectangular wave.

The level of the voltage to this second internal comparator can be varied from two-thirds of the $V_{cc}$ level by the application of an external control voltage. Therefore, for the same threshold level input, the output trailing level can be adjusted by the application of a control voltage input.

The operation of the two timer networks shown in FIG. 4*b* may now be considered. The input that starts the operation of delay timer 28 is produced from power supply and zero-crossing detector 30. The line voltage following transformation to a nominal value of about 12 volts in transformer 118, is applied through rectifier diodes 120 and 122. The outputs from these diodes are furnished through diode 124 to capacitors and regulator 126 to produce a regulated bias voltage for the electronics in the rest of the circuits. Also, the outputs from diodes 120 and 122 present a base drive voltage to transistor 128 after each zero-crossing. Therefore, a pulse is produced from transistor 128 twice each cycle of line voltage, once as it goes through zero from a negative to a positive value and again as it goes through zero from a positive to a negative value. The output is inverted and amplified in inverter 130 (FIG. 4*a*) and applied as the trigger input (T) to timing element 132 of the Model 555 type described hereinabove.

It may be remembered that timing element 132 is triggered on by a negative-going trigger input. Therefore, the output (O/P) rises to a positive value 34 with the application of the trigger.

The control voltage (CV) input is determined by the charge built up on capacitor 134 as determined by the input applied thereto on line 136 from voltage conditioning circuit 138. An RC time constant network comprising variable resistor 140 and capacitor 142 determines the threshold level input (TH) applied to timing element 132. Transistor 144 of this time constant network linearizes the operation of this threshold network since without the transistor the threshold build-up would be exponential. In any event, when the threshold level reaches a predetermined value, there is the resulting negative-going edge 36 to the rectangular output. The RC network, although adjustable during set up, is not actively variable with operation. However, the voltage occurring on line 136 does change the control voltage build-up on capacitor 134 and therefore is the mechanism by which the time interval between rising edge 34 and decaying edge 36 is determined.

The negative-going edge from timing element 132 is passed by diode 146 to trigger timing element 148. The occurrence of the trigger produces the leading and rising edge 40 of the output from element 148. The control voltage for element 148 is established on capacitor 150 by variable resistor 152 connected to a fixed bias voltage value. Therefore, once set, the control voltage does not vary. The RC threshold network comprising variable resistor 154, transistor 156 and capacitor 158 operates in a linear fashion similar to the RC threshold network to element 132; however, note that there is a variable input on line 160 from the voltage conditioning circuit. Hence, the threshold does not build up from the same starting point for each half cycle of operation. Hence, trailing or negative-going output edge 42 is operationally variable from leading edge 40 in accordance with the input on line 160. But, in any event, the negative-going edge passes through OR gate 114, is inverted in current amplifier 112 and activates photodriver 24 for controlling power output 10 to the lamp network, as previously discussed.

Now referring to FIG. 4*a*, that part of the input section of the circuit is shown which produces the output from the alternate inputs. The primary steering elements are analog switches 162 and 164. The inputs to these circuits are identified as "L1, L2, L3 and L4", the outputs are identified as "O1, O2, O3 and O4", and the control inputs are identified as "C1, C2, C3 and C4". Operationally, when a control input of a given number is present, the input is connected to its correspondingly numbered output. Otherwise, the connection is open.

When power is first applied to the circuit and also to the lamp network, dimming operation is prevented to permit the lamps to stabilize as they warm up. This is provided by ripple counter 166 in so-called two minute timer 168. Each pulse resulting from a zero-crossing detection of line voltage from amplifier and inverter 130 is passed through OR gate 170 and is counted by counter 166 until $2^{14}$ pulses (approximately 136 seconds) are counted. The output and the inverted output through inverter 172 from counter 166 are applied respectively to control inputs C1 and C4 of steering switch 164. This assures a grounded output through L4–O4 before there is a high output from counter 166 and an open switch between L1 and O1. When the number is counted to enable dimming operation, the switch is opened between L4 and O4 and the switch is closed between L1 and O1. It also should be noted that a latching connection from 014 of counter 166 through OR gate 170 assures dimming enablement until counter 166 is reset.

Lower limit adjust network 174 provides an output voltage condition circuit 138 on line 176. A low voltage output produces an early notch and a high voltage output produces a later notch, as described hereinabove from the timer networks. A zener diode 178 establishes a basic low voltage output for nominal operation. This lower limit can be set to a slightly higher value through the manual adjustment of resistor 180 connected through amplifier 182 and diode 184. Once set, the operation is variable only by a voltage level applied through gating diode 186 which exceeds the lower limit set level. Notice also that through "OFF" switch 188, ground can be applied to the variable input to diode 186, thereby dropping operation back to the level set through diode 184.

When "OFF" switch 188 is open, the variable input comes through L1–O1 of steering switch 164 and amplifier 190 either through the L2–O2 connection or the L3–O3 connection as determined by the application of control voltage to either C2 or to C3. When "MAN." switch 192 is closed, then there is an output through the switch from the Q output of flip-flop 194 after it is set to control input C3. This connects L3 to O3, the dimming voltage being established manually by manual potentiometer 196.

When the circuit is set up for automatic operation, then "AUTO" switch 198 is closed, which resets flip-flop 194 and produces a $\overline{Q}$ output therefrom to control input C2 of steering switch 162. This establishes a connection between L2 and O2 so that the input to L2 controls the dimming operation.

Now referring to photocell detect circuit 198, a light level adjust variable resistor 200 produces an output through amplifier 202 to comparator 204. The connection of this output is to the negative input terminal of the comparator. The positive input terminal of the comparator is connected to the photosensor portion of the detect network.

Photosensor 206 is positioned to detect the ambient light in the area also illuminated by the fluorescent or other artifical lamps under control of the overall dimmer circuit. The voltage output from the sensor is proportional to the ambient light. That is, a relatively bright ambient light condition produces a relatively high voltage output, which results in a relatively large amount of dimming. This means that the ambient light and the artificial light will produce about the same amount of total light within the range of circuit operation. In all events, the output from photosensor 206 is amplified in operational amplifier 208, which produces a feedback signal through variable resistor 210, which acts as a sensitivity control. The output is also applied through amplifier 212 to comparator 204. Comparator 204 produces an output which is determined by the voltage difference between the inputs. Only a positive voltage difference in favor of a voltage from the photosensor section has an ultimate effect on circuit performance because in the lower limit adjust circuit, the minimum operational voltage is maintained through diode 184.

LED's 214 and 216 operate to show which of the two modes of control is in control of the operation of the circuit. LED 214 is activated when "MAN." switch 192 is closed since there is a high output applied thereto from output Q of flip-flop 194 resulting from series-connected inverters 218 and 220. Since LED 216 is connected to the output of only the first of these inverters, then it is not activated during this same time. On the otherhand, when "AUTO" switch 198 is closed instead and flip-flop high $\overline{Q}$ output, then LED 216 is activated and LED 214 is deactivated.

Note that either switch 192 or 198 establishes a return path for these LED's through operation of OR gate 222, which, in turn produces a Q output from flip-flop 224.

Switch 188, which is identified as the "OFF" switch, in addition to having a set of normally open switch contacts previously discussed, also has a set of normally closed switch contacts. The closing of switch 199 removes the return from the LED lamps, and produces an output from terminal $\overline{Q}$ of flip-flop 224 to reset ripple counter 166 and produces an output to OR gate 114. This last connection assures absolutely that no dimming pulse action operates photodriver 24, but that the driver is operated to assure no dimming operation, either manually or by automatic operation.

Now returning to voltage conditioning circuit 138, and assuming either manual or automatic operation, a regulating voltage output from lower limit adjust network 174 on line 176 is applied to amplifier 226. The output therefrom is applied as the control voltage setting for timer 132. A low voltage means that the time for the RC threshold to reach the activiation level is relatively short. The output from the delay timer determines where within the half cycle the notch occurs. Therefore, for a low control voltage to timer 132, the notch occurs close to the zero-crossing point.

As previously discussed, the width of the notch is determined by the voltage on line 160 connected to the RC threshold components connected to timer 148. A relatively large voltage means a relative large notch.

The voltage on line 160 is a combination of the output from amplifier 228 and the setting of variable resistor 230. Amplifier 228 receives its input from amplifier 226. There is no input from amplifier 228 until the input exceeds a predetermined value, so only the setting of resistor 230 determines the notch width from the pulse timer. For large voltage values, however, there is an output from amplifier 228. Therefore, the total voltage on line 160 becomes larger and results in a larger notch.

The operation of the circuit just described ensures the voltage notch developments as shown in FIG. 2 wherein the notching is small and of the same width for small dimming operation, differing only in position from the zero-crossing point. For the lowest of the dimming operation, the notch is located nearest the zero-crossing of the waveform shown in FIG. 2(*i*). When the voltage reaches a certain value, not only is the notch moved closer to the peak occurrence of the waveform, but also the notch widens.

While a particular embodiment of the invention has been shown, it will be understood that the invention is not limited thereto, since many modifications may be made. For example, although gradual placement and width notching is varied within the first half portion of each half cycle as shown in FIG. 2, operation could be in the second half portion of each half cycle and achieve a similar dimming performance.

What is claimed is:

1. A lamp dimmer for connection to at least one lamp circuit for interrupting a portion of each positive and negative half cycle of applied distribution line current to the lamp circuit, comprising diode routing means connected to the distribution line and to the lamp circuit for providing line voltage to the lamp circuit, an electronic switch connected to provide means for interrupting voltage through said diode routing means, a photocontroller including a photocontrol driver and a photocontrol receiver for operating said electronic switch, an automatically adjustable pulse timer for pulse operating said photocontrol driver, the output therefrom being adjustable with respect to pulse width within the first part of each half cycle of applied line voltage as dependent on the location of the onset of the timer operation, a delay timer connected to said pulse timer for determining the onset of timer operation of said photocontrol driver, a zero-crossing detector for producing an output with each line voltage zero-crossing and connected to said delay timer, and input means for determining the amount of dimming, said input means being connected to said delay timer, the level output determining the output of said delay timer with respect to said zero-crossing output of said detector.

2. A lamp dimmer in accordance with claim 1, wherein said adjustable pulse timer produces the same pulse width output over an initial range of timer operation onset positions.

3. A lamp dimmer in accordance with claim 1, wherein said input means comprises photosensor means for detecting the level of external light and automatically establishing a dimming voltage related thereto, and lower limit means connectable to the output of said photosensor for preventing a dimming voltage from being applied to said delay timer until a predetermined lower threshold level has been exceeded.

4. A lamp dimmer in accordance with claim 3, wherein said photosensor means includes a comparator for comparing an external light with a standard level and establishing a dimmer voltage dependent on the difference therebetween.

5. A lamp dimmer in accordance with claim 3, wherein said input means includes a steering switch between said photosensor and said lower limit means.

6. A lamp dimmer in accordance with claim 5, and including manual input means connected to said steering switch for providing a manually determinable dimming voltage to said lower limit means.

7. A lamp dimmer in accordance with claim 5, wherein said input means includes a fixed delay means connected to said steering switch for preventing a dimming voltage from being applied to said lower limit means until a predetermined fixed period of time lapses after initial application of line voltage.

8. A lamp dimmer in accordance with claim 1, wherein the output from said pulse timer is adjustable as to time of occurrence and with respect to width with a change of output from said input means.

9. A lamp dimmer in accordance with claim 8, wherein progressively large voltages from said input means produce progressively later onsets of said dealy timer operation and progressively larger pulse widths from said adjustable pulse timer.

10. A lamp dimmer in accordance with claim 9, wherein said delay timer includes a Model 555 timer with a variable control voltage input terminal wherein said input means produces a variable control voltage input to said terminal.

11. A lamp dimmer in accordance with claim 9, wherein said pulse timer includes a Model 555 timer with a variable RC threshold input means and wherein said input means produces a variable threshold voltage input for changing the threshold operating level of said threshold input means.

* * * * *